United States Patent [19]

Yoshida et al.

[11] 4,038,082

[45] July 26, 1977

[54] IMAGE-RECEIVING MATERIAL FOR COLOR DIFFUSION TRANSFER COMPRISING PVA AND POLYMETHYLOL COMPOUNDS

[75] Inventors: Takashi Yoshida; Nobuo Yamamoto, both of Minami-ashigara, Japan

[73] Assignee: Fuji Photo Film Co., Ltd., Minami-ashigara, Japan

[21] Appl. No.: 501,934

[22] Filed: Aug. 30, 1974

[30] Foreign Application Priority Data

Aug. 30, 1973 Japan ..... 48-97633

[51] Int. Cl.[2] ..... G03C 1/40; G03C 7/00; B44D 1/44; B44D 1/09

[52] U.S. Cl. ..... 96/77; 96/3; 96/29 D; 96/119 R; 427/340; 428/500; 526/9

[58] Field of Search ..... 96/3, 29 D, 77, 119 R, 96/111; 117/62, 62.2, 161 UE; 427/340, 337; 428/500; 260/621 K; 526/9

[56] References Cited

U.S. PATENT DOCUMENTS

| | | | |
|---|---|---|---|
| 2,367,511 | 1/1945 | Lowe et al. | 96/111 |
| 2,481,676 | 9/1949 | Lowe | 96/111 |
| 2,732,316 | 1/1956 | July et al. | 96/111 |
| 3,003,872 | 10/1961 | Blout et al. | 96/29 D |
| 3,239,338 | 3/1966 | Rogers | 96/3 |
| 3,287,127 | 11/1966 | Dershowitz | 96/3 |
| 3,295,970 | 1/1967 | Rogers | 96/29 D |
| 3,453,113 | 7/1969 | Ofstead et al. | 96/114 |
| 3,460,941 | 8/1969 | Haas | 96/29 D |
| 3,586,503 | 6/1971 | Taylor | 96/111 |
| 3,625,691 | 12/1971 | Ohyama et al. | 96/77 |
| 3,752,692 | 8/1973 | Young | 96/76 R |

OTHER PUBLICATIONS

"Reactions of Formaldehydes and Derivatives," *Encyc. of Polymer Science and Techn.*, vol. 4, 1967, pp. 372–375.

*Primary Examiner*—David Klein
*Assistant Examiner*—Richard L. Schilling
*Attorney, Agent, or Firm*—Sughrue, Rothwell, Mion, Zinn and Macpeak

[57] ABSTRACT

An image-receiving element for color diffusion transfer photography for use with a photographic element containing at least one silver halide emulsion layer having incorporated therein a dye image forming material that is soluble in alkaline solution and becomes diffusible upon development of the silver halide emulsion layer with an alkaline processing solution, and to which the dye image forming material is imagewise transferred when the alkaline processing solution is spread between the image-receiving element and the photographic element; in which the image-receiving element comprises a support having at least one hydrophilic colloid layer thereon, at least one layer of the image-receiving element containing an alkaline solution-soluble hydrophilic synthetic polymer and a polymethylol compound.

8 Claims, No Drawings

IMAGE-RECEIVING MATERIAL FOR COLOR DIFFUSION TRANSFER COMPRISING PVA AND POLYMETHYLOL COMPOUNDS

BACKGROUND OF THE INVENTION

1. Field of the Invention

This invention relates to a color diffusion transfer photographic material, and especially to a color diffusion transfer photographic image-receiving material.

2. Description of the Prior Art

Various methods of color diffusion transfer photography are known and include, for example, the method involving the use of a dye developer as disclosed in U.S. Pat. No. 2,983,606, the method involving the use of a diffusible dye formed by the reaction of a color former and an oxidation product of a developer as disclosed in U.S. Pat. Nos. 3,227,550 and 3,227,551, or the methods disclosed, for example, in U.S. Pat. No. 3,628,952 or Japanese Patent Publication No. 10240/59. These prior methods have aspects in common in that a combination of an image-receiving layer and a silver halide emulsion layer containing a dye image forming substance is used, and the silver halide emulsion layer after exposure is treated with an alkaline processing solution of high pH thereby to transfer the diffusible dye to the image-receiving layer.

It is well known on the other hand that a synthetic polymer is used as a film-forming material in a color diffusion transfer image-receiving material (see, for example, U.S. Pat. No. 3,148,061). However, since the synthetic polymer should have the function of receiving the dye upon being processed with the alkaline processing solution, it is difficult to render the synthetic polymer alkali resistant and especially water resistant.

As is well known in the art, the general procedure for rendering the photographic layer processing resistant, such as alkali resistant and water resistant, is to incorporate a cross-linking agent in the photographic layer. In fact, a cross-linking agent such as formaldehyde or glyoxal is used in color diffussion transfer photographic materials.

Since gelatin is generally used as a film-forming substance (binder) in photographic materials, the use of such a cross-linking agent as mentioned above is sufficient. However, synthetic polymers, especially polyvinyl alcohol, can not be fully cross-linked with these cross-linking agents. This deficiency is especially marked when the polymers are processed at a high pH.

SUMMARY OF THE INVENTION

Accordingly, an object of this invention is to provide an image-receiving material for color diffusion transfer photography which contains a synthetic polymer as a film-forming agent and has improved water resistance and alkali resistance.

Another object of this invention is to provide a color diffusion transfer photographic material including an image-receiving material containing a synthetic polymer as a film-forming agent and adapted to be processed at a high pH.

The above objects of this invention are achieved by cross-linking at least one layer containing a hydrophilic synthetic polymer in a color diffusion transfer image-receiving material with a polymethylol compound.

According to this invention, an image-receiving material is provided for color diffusion transfer photography. The image-receiving material is used together with a photographic element containing at least one silver halide emulsion layer having incorporated therein a dye image forming material that is soluble in alkaline solution and becomes diffusible upon development of the silver halide emulsion layer with an alkaline processing solution, and to which the dye image forming material is transferred imagewise when the alkaline processing solution is spread between the image-receiving material and the photographic element; in which the image-receiving material comprises a support having at least one layer thereon, with at least one layer of the image-receiving material containing an alkali-soluble hydrophilic synthetic polymer and a polymethylol compound.

DETAILED DESCRIPTION OF THE INVENTION

The polymethylol compound used in this invention is a compound containing at least two N-methylol residues (>N—$CH_2OH$) bonded to the nitrogen atom adjacent a carbonyl group or the activated carbon atom within a heterocyclic ring, or at least two methylol residues (—$CH_2OH$) bonded together directly or through an activated carbon atom. Useful polymethylol compounds are melamine compounds or urea compounds in which the nitrogen atom is substituted with at least two methylol residues and phenol compounds containing at least two methylol residues as substituents.

Especially useful polymethylol compounds are expressed by the following general formulae (I), (II) and (III).

(I)

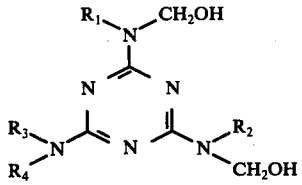

(II)

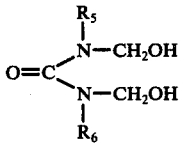

(III)

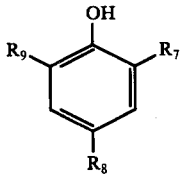

In the above formulae, $R_1$, $R_2$, $R_3$ and $R_4$ each represents a hydrogen atom, a methylol group or an alkyl group, e.g., having 1 to 6 carbon atoms such as a methyl, ethyl, propyl or butyl group; $R_5$ and $R_6$ each represents a hydrogen atom, a methylol group or an alkyl group, e.g., having 1 to 6 carbon atoms such as a methyl, ethyl, propyl or butyl group, and can combine as an alkylene group such as an ethylene group, a propylene group, etc., to form a ring; $R_7$, $R_8$ and $R_9$ each represents a hydrogen atom, a methylol group or an alkyl group such as a methyl, ethyl, propyl or butyl group; and at least two of $R_7$ to $R_9$ are methylol groups.

These polymethylol compounds form oligomers (e.g., having a degree of polymerization of 1 to about 20) or polymers (e.g., having a degree of polymerization of about 20 to 200) as a result of intramolecular condensation. Of these, oligomers of a low degree of polymerization can be effectively used in this invention in the same manner as the monomers.

Specific examples of polyvalent methylol compounds which can be used in this invention are shown below.

Compound 1

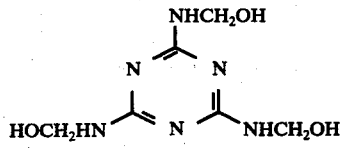

Compound 2

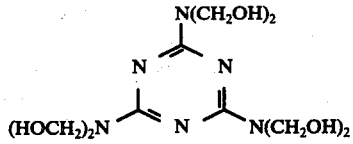

Compound 3

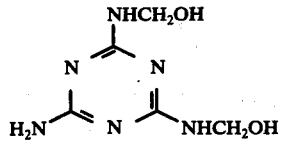

Compound 4

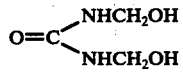

Compound 5

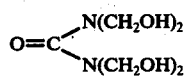

Compound 6

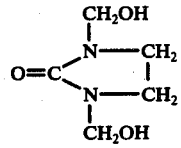

Compound 7

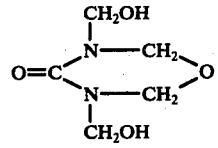

Compound 8

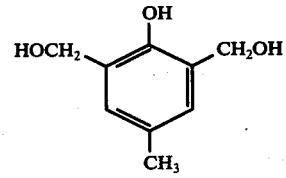

Compound 9

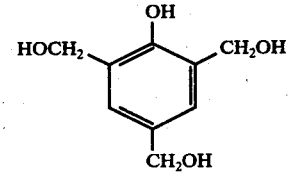

Compound 10

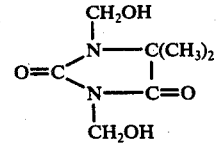

Compound 11

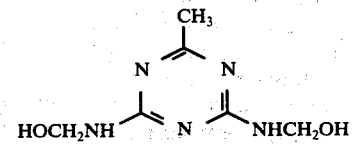

-continued
Compound 12
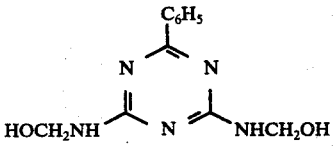
Compound 13
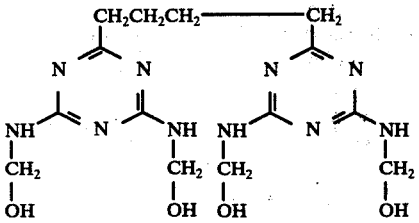
Compound 14
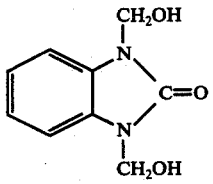
Compound 15 $HOCH_2-NHCO-(CH_2)_4-CONH-CH_2OH$
Compound 16 $HOCH_2-NHCO-O-(CH_2)_4-O-CONH-CH_2OH$
Compound 17
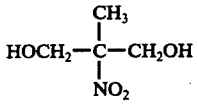
Compound 18
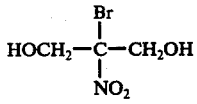
Compound 19
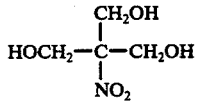
Compound 20 $HOCH_2-NH-C(=O)-NH-CH=CH-CH_2OH$
Compound 21
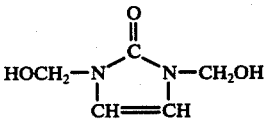
Compound 22
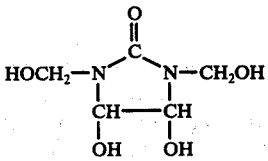
Compound 23
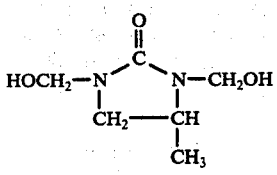
Compound 24
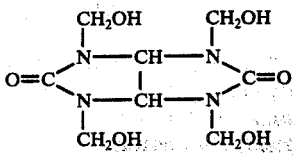

-continued

Compound 25

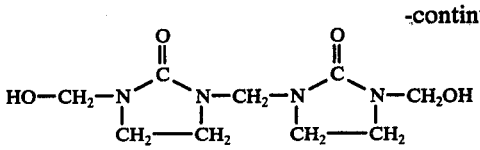

Compound 26

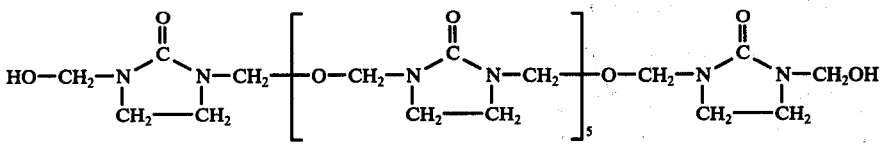

Compound 27

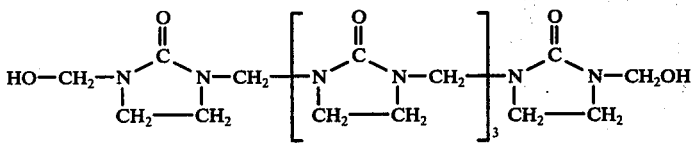

Compound 28

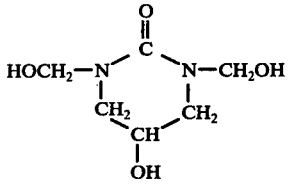

Compound 29

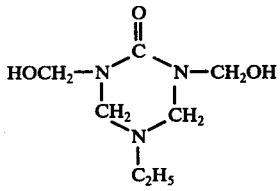

Compound 30

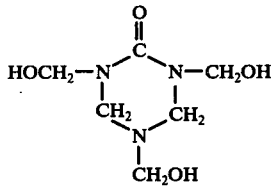

Compound 31

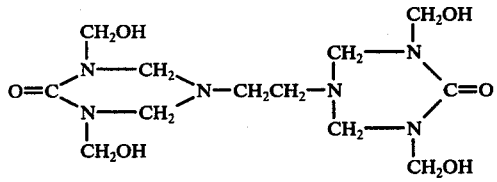

The above compounds can be prepared by reacting melamines, ureas or phenols with formaldehyde, and the number of methylol groups is determined by the degree of reaction with formaldehyde.

The amount of the polymethylol compound is usually about 0.1 to 10% by weight based on the weight of the synthetic polymer, and the preferred amount is about 0.5 to 5% by weight.

The cross-linking action of the polymethylol compound is enhanced when it is used together with a non-volatile acid, e.g., having a boiling point above 100° C, preferably above 150° C, such as phosphoric acid, sulfuric acid or benzenesulfonic acid, usually known as a dehydrating agent in order to promote the dehydration reaction at the time of cross-linking.

The synthetic polymer to be cross-linked with the polymethylol compound is a water-soluble highly polymeric compound having a film-forming ability and contains a hydroxyl group or a carboxyl group which is capable of reaction with the methylol group of the polymethylol compound or which forms these groups by reaction, and those water-soluble highly polymeric compounds containing a hydroxyl group are especially preferred. A typical example is polyvinyl alcohol. Desirably, the polyvinyl alcohol used for this purpose has a molecular weight of at least about 10,000 up to about 300,000, and contains at least about 30 mol% of a unit of the formula

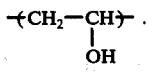

The polyvinyl alcohol, used in this invention, can either be a homopolymer or copolymer. In the copolymer, the other structural unit can be a structural unit derived from an ethylenically unsaturated monomer such as an acrylate (e.g., ethyl acrylate, propyl acrylate or butyl acrylate), a methacrylate (e.g., ethyl methacrylate, propyl methacrylate or butyl methacrylate), vinyl pyridine or vinyl imidazole. Examples of such polymers include a hydrolysis product of a copolymer of vinyl acetate and N-vinyl pyrrolidone or polyvinyl acetate having a degree of saponification of at least 30 mol%. The polyvinyl alcohol also includes a graft polymer obtained by reacting another vinyl monomer such as 4-vinyl pyridine in the presence of polyvinyl alcohol.

The hydrophilic synthetic polymer, such as polyvinyl alcohol, used as a film-forming agent can be used alone or in conjunction with one of more natural or synthetic polymers. Examples of these other polymers are hydroxyethyl cellulose, hydroxypropyl cellulose, phthalic-modified gelatin, polyacrylamide, polyacrylic acid, poly-4-vinyl pyridine, and poly-N-vinyl pyrrolidone. When used with the other polymer, the hydrophilic synthetic polymer is employed in an amount of at least 50% by weight, preferably at least 70% by weight.

The image-receiving material for color diffusion transfer photography in accordance with this invention comprises basically a transparent support having an image-receiving layer thereon. The image-receiving layer contains the synthetic polymer and the polymethylol compound and if desired, a mordanting agent. A suitable amount of the polymethylol compound ranges from about 0.1 to 10% by weight, preferably 1 to 5% by weight, to the weight of the polymer. The image-receiving layer can be formed in advance on the support, or as a result of spreading an alkaline processing solution containing the synthetic polymer and the mordanting agent on the support at the time of processing. If desired, the image-receiving material can include a neutralizing layer and/or a timing layer (or spacer layer) between the support and the image-receiving layer.

The neutralizing layer is provided so as to stabilize the dye image by absorption of the alkaline processing solution after processing (that is, after the dye image has been formed in the image-receiving layer by diffusion transfer), and is specifically disclosed, for example, in U.S. Pat. Nos. 3,362,821 and 3,455,686. The neutralizing layer contains a compound which can react with an alkali metal hydroxide such as potassium or sodium hydroxide, an organic base such as hydroxylated tetramethyl ammonium salt, or organic acid group, such as carboxylic acid or sulfonic acid group, capable of forming a salt with a quaternary ammonium salt, or organic acid anhydride, an organic acid ester, or a group capable of acting as an organic acid group by easy reaction with the alkali in the processing solution, such as a lactone. Compounds which are relatively difficultly diffusible, such as oleic acid or palmitic acid, are desirable. Acid polymers are especially preferred examples because they do not diffuse. Examples of acid polymers are dicarboxylic acid half ester derivatives of cellulose containing a free carboxyl group such as cellulose acetate hydrogen phthalate or cellulose acetate hydrogen succinate, copolymers of maleic anhydride, acrylic acid, methacrylic acid or sulfostyrene as a comonomer, or homopolymers of these monomers, or polyvinyl alcohols partially acetalized with aldehydes having a carboxylic acid group or sulfonic acid group as a substituent. More specific examples of acid polymers are disclosed, for example, in U.S. Pat. No. 3,362,819, and include a monobutyl ester of a 1:1 molar ratio copolymer of maleic anhydride and ethylene, a monobutyl ester of a 1:1 molar ratio copolymer of maleic anhydride and methyl vinyl ether, a monoethyl, monopropyl, monopentyl or monohexyl ester of a 1:1 molar ratio copolymer of maleic anhydride and ethylene, a monoethyl, monopropyl, monopentyl or monohexyl ester of a 1:1 molar ratio copolymer of maleic anhydride and methyl vinyl ether, polyacrylic acid, polymethacrylic acid, copolymers of acrylic acid and methacrylic acid in varying proportions, or copolymers of acrylic acid or methacrylic acid with other vinyl monomers in varying proportions. Generally, such a polymer is dissolved in an alcohol such as methanol, ethanol, propanol or butanol, a ketone such as acetone, methyl ethyl ketone or cyclohexanone, an ester such as ethyl acetate or butyl acetate, or a mixture of these solvents, and then coated on the support.

The thickness of the acid polymer layer coated varies according to the composition and amount of the processing solution used, and can not be unequivocally set forth. Generally, a suitable thickness is about 5 to 30 microns.

It is also possible to incorporate in the neutralizing layer an acid group-free polymer such as a cellulose ester or a polymer having a low acid group content (for example, cellulose acetate hydrogen phthalate) in addition to the compound containing an acid group. This serves to retard the neutralization.

The timing layer (or spacer layer) is provided between the neutralizing layer and the image-receiving layer in order to regulate the rate of neutralization by the neutralizing layer. Usually, this layer comprises a layer of an alkali solution-permeable and water-permeable polymer. Examples of such a polymer are polyvinyl alcohol disclosed in U.S. Pat. No. 3,362,819, a graft polymer of polyvinyl alcohol disclosed in U.S. Pat. No. 3,575,701, and a homopolymer, copolymer or graft copolymer of a monomethacrylic acid ester or monoacrylic acid ester of a polyhydric alcohol. Examples of the monomethacrylates or monoacrylates of polyhydric alcohols include 2-hydroxyethyl methacrylate, 3-hydroxypropyl methacrylate, 2-hydroxypropyl methacrylate, 4-hydroxybutyl methacrylate, 5-hydroxypentyl methacrylate, 2,2-dimethyl-3-hydroxypropyl methacrylate, diethylene glycol monomethacrylate, trimethylol propane monomethacrylate, pentaerythritol monomethacrylate, 2-hydroxyethyl acrylate, 3-hydroxypropyl acrylate, 2-hydroxypropyl acrylate, 4-hydroxybutyl acrylate, 5-hydroxypentyl acrylate, 2,2-dimethyl-3-hydroxypropyl acrylate, diethylene glycol monoacrylate, trimethylol propane monoacrylate, and pentaerythritol monoacrylate.

Where layers (for example, the neutralizing layer or timing layer) other than the image-receiving layer contain a synthetic polymer such as polyvinyl alcohol, such layers can contain the above-mentioned polymethylol compound as a cross-linking agent.

Basic mordanting agents capable of mordanting the dye image forming materials can, for example, be a homo- or co-polymer of a vinylene compound containing a nitrogen-containing hetero ring such as pyridine or imidazole, a cationic polymer in which the nitrogen in a nitrogen-containing heterocyclic ring is quaternized, a homo- or co-polymer of an acrylic acid derivative (for example, an acrylic acid ester or acrylamide) or a methacrylic acid derivative (for example, a methacrylic acid ester or methacrylamide) containing a tertiary amino group such as a dimethylaminoethyl or guanidyl group, or a cationic polymer in which a tertiary amino group is quaternized. Examples of preferred mordants are basic homopolymers or copolymers having recurring units of the following formulae (with a molecular weight of at least about 500, generally about 10,000 to 300,000, preferably 10,000 to 100,000).

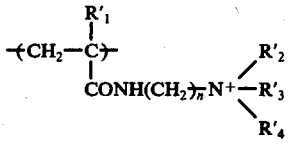

X⁻

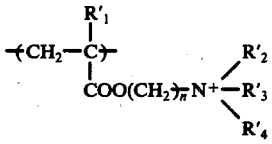

X⁻

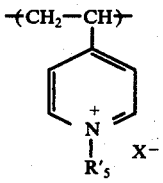

X⁻

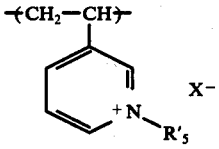

X⁻

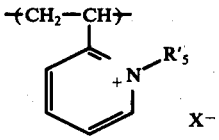

X⁻

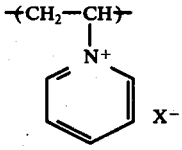

X⁻

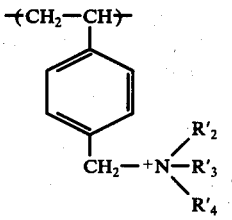

X⁻

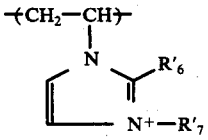

X⁻

-continued

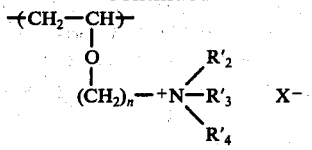

X⁻

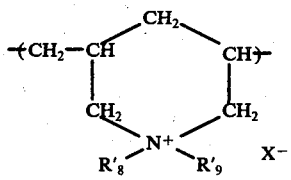

X⁻

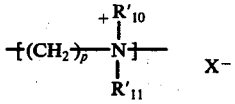

X⁻

In the above formulae, $R'_1$ is a hydrogen atom or a methyl group; $R'_2$, $R'_3$, $R'_4$, $R'_5$, $R'_7$, $R'_8$, $R'_9$, $R'_{10}$ and $R_{11}$ each represents a hydrogen atom or an organic group bonded via a carbon atom such as an alkyl group, e.g., methyl, ethyl, n-propyl, isopropyl, etc., an aralkyl group, e.g., benzyl,

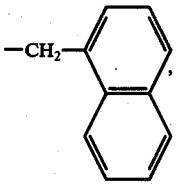

and an aryl group, e.g., phenyl and tolyl; $R'_6$ is a hydrogen atom or an alkyl group containing 1 to 4 carbon atoms such as a methyl, ethyl, propyl and butyl group; X⁻ is an acid anion (for example, an anion of sulfuric acid, hydrochloric acid, nitric acid, phosphoric acid, or p-toluenesulfonic acid); *p* is an integer of 2 to 4; and *n* is 1 or 2.

The alkaline processing solution usually has a high pH, and desirably a pH of at least 10. More advantageously, the pH of the processing solution is at least 12. In order to increase the pH of the alkaline processing solution, a well-known alkaline agent is used. Examples are sodium hydroxide, potassium hydroxide, lithium hydroxide, ammonium hydroxide, sodium phosphate, potassium phosphate, sodium carbonate, potassium carbonate, sodium borate, and sodium metaborate.

The alkaline processing solution can further contain a developing agent (for example, 4-diethylamino-aniline, 4-N-ethyl-N-methansulfonamidoaminoethyl-2-methylaniline, butyl-hydroquinone, or 4-N-methylamino-phenol), an antifoggant (for example, potassium bromide, potassium iodide, 1-phenyl-5-mercaptotetrazole, benzotriazole, 6-nitrobenzimidazole, or 6-nitroindazole), a water-miscible organic solvent (for example, ethanol, N,N-dimethylformamide, or tetrahydrofuran), a solvent for silver halide (for example, sodium thiosulfate, ammonium thiosulfate, sodium thiocyanate, or uracil), or a thickening agent (for example, polyvinyl alcohol).

The dye image forming material can be selected from those disclosed in U.S. Pat. No. 2,983,606. The use of a dye developer as the dye image forming material will be described later on.

Instead of the dye developer, other substances can also be used as the dye image forming material. For example, the dye image forming materials disclosed in U.S. Pat. Nos. 2,647,049; 2,661,293; 2,698,244; 2,698,798; 2,802,735; 3,630,731; and 3,635,707 are color formers which form diffusible dyes under alkaline conditions by reaction with dye developers. Furthermore, the hydrazone compound having attached thereto a group which are disclosed in U.S. Pat. No. 3,628,952 can be used as the dye image forming material. Moreover, quinone-type and leuco dye developers to be used in conjunction with auxiliary developers as disclosed in Japanese Patent Publication No. 10240/59 can be used as the dye image forming material in this invention.

All of the above exemplified dye image forming materials are not dye developers, but can be used for color diffusion transfer photographic film units of this invention in the same manner as dye developers.

For simplicity of description, the present invention will further be described below with reference to a color diffusion transfer photographic film unit using a dye developer. However, it should be noted that the inclusion of this description of the color diffusion transfer process using a dye developer is not to be construed as limiting the dye image forming materials which can be used in this invention to dye developers alone.

A dye developer is a compound which contains in the molecule a portion acting as a developer and a dye portion having light absorption in the visible region. The dye developer is soluble in an alkaline liquid of high pH, and that portion of the dye developer which functions as a developer acts on the exposed silver halide grains to reduce the silver halide to silver, and the developer portion is oxidized. Alternatively, other kinds of developers reactive with silver halide, for example, colorless auxiliary developers, act on the silver halide grains, whereby the oxidation product of the auxiliary developer leads to the oxidation of the developer portion. Auxiliary developers are described hereinafter. Due to the low solubility of the oxidation product of the dye developer in an alkaline liquid of high pH, or as a result of a further reaction of the oxidation product of the dye developer with an amino, mercapto, active methylene or active methine group thereby to render the oxidation product of the dye developer non-diffusible by attachment to such a group, the imagewise fixation of the dye developer is effected as a function of the amount of exposure in the region where the photosensitive silver halide is exposed. Substances with which the dye developer oxidation product can further react are, for example, gelatin, polyethyleneimine derivatives, ω-cyanoacetophenone derivatives, 5-pyrazolone derivatives, β-diketone derivatives, and alkyl-substituted nitrogen-containing heterocylic compounds. For example, it is possible to dissolve a compound such as p-methoxy-ω-cyanoacetophenone, 1-phenyl-3-benzoylamino-5-pyrazolone, benzoyl-acetanilide, 1-phenyl-3-methyl-4-methyl-5-pyrazolone, N-benzyl-2-ethylpyridinium bromide, N-phenethyl-2-picolinium bromide, or N-phenethyl-4-methyl-pyridinium bromide in an alkaline processing solution, and permeating the liquor in a photographic layer so as to react the compound with the oxidation product of the dye developer. Alternatively, it is possible to add a compound such as 4-hexadecenylsuccinylamino-ω-cyanoacetophenone, or 4-hexadecyloxy-benzoyl-aceto-3',5'-dicarboxylanilide in a silver halide emulsion layer or an interlayer or a protective layer so as to react the compound with the oxidation product of the dye developer.

A typical example of the developer portion of the dye developer is a phenyl group in which at least two substituents selected from a hydroxyl group, an amino group and an alkylamino group are substituted at the o- or p-position to each other. The phenyl group can further be substituted with, for example, one or more of an amino, alkylamino, alkyl, hydroxy, alkoxy, or halogen substituent. A precursor of a developer capable of forming a developer portion due to the action of alkali can also be used. For example, dye developers derived from a 2,5-dihydroxyphenyl group, a 3,4-dihydroxyphenyl group, a 4-methyl-2,5-dihydroxyphenyl group or a 2,5-trifluoroacetoxyphenyl group are preferred.

The dye developers as used in the present invention are dye developers, which are described in U.S. Pat. Nos. 2,983,605; 2,983,606; 2,992,106; 3,047,386; 3,076,808; 3,076,820; 3,077,402; 3,126,280; 3,131,061; 3,134,762; 3,134,765; 3,135,604; 3,135,605; 3,135,606; 3,135,734; 3,141,772; 3,142,565; 3,218,164; 3,230,082; 3,230,083; 3,239,339; 3,320,063; 3,453,107; 3,579,334; 3,482,972; and 3,563,739; Australian Pat. No. 220,279; German Pat. No. 1,036,640; British Pat. Nos. 804,971; 804,973; 804,974; and 804,975; Belgian Pat. Nos. 554,935 and 568,344; Canadian Pat. Nos. 579,038 and 577,021; French Pat. No. 1,168,292; etc.

The dye developers are characterized in that they are slightly soluble in water and non-diffusible under acidic and neutral conditions and they are diffusible under alkaline condition.

Representative examples of the dye developers include the following compounds.

1-Phenyl-3-N-n-hexylcarbamoyl-4-p-(2-hydroquinonylethyl)phenylazo-5-pyrazolone 2-p-(2-Hydroquinonylethyl)-phenylazo-4-isopropoxy-1-naphthol 1,4-bis[β-(Hydroquinonyl-isopropyl)amino]-5,8-dihydroxyanthraquinone 1-Phenyl-3-n-butyl-carbamoyl-4-[p-(2',5'-dihydroxyphenethyl)phenylazo]-5-pyrazolone 1-Phenyl-3-N-n-hexylcarbamoyl-4-[p-(2',5'-dihydroxyphenethyl)phenylazo]-5-pyrazolone 1-Phenyl-3-carbethoxy-4-[p-(2',5'-dihydroxyphenethyl)phenylazo]-5-pyrazolone 2-[p-(2',5'-Dihydroxyphenethyl)phenylazo]-4-isopropoxy-1-naphthol 1-Phenyl-3-N-cyclohexylcarbamoyl-4-[p-(2',5'-dihydroxyphenethyl)-phenylazo]-5-pyrazolone 1-Phenyl-3-phenyl-4-[p-(2',5'-dihydroxyphenethyl)-phenylazo]-5-pyrazolone 1-Phenyl-3-amido-4-{4'-[p-(2'',5''-dihydroxyphenethyl)phenylazo]-2',5'-diethoxyphenylazo}-5-pyrazolone 1-Phenyl-3-N-cyclohexylcarbamoyl-4-[p-(2',5'-dihydroxyphenethyl)-phenylazo]-5-pyrazolone 1-Phenyl-3-phenyl-4-[p-(2',5'-dihydroxyphenethyl)-phenylazo]-5-pyrazolone 1-Phenyl-3-methyl-4-[p-(2',5'-dihydroxyphenethyl)-phenylazo]-5-pyrazolone 1-Phenyl-3-(N-n-heptyl)carbamoyl-4-[p-(β-hydroquinonylethyl)-phenylazo]-5-pyrazolone 1-(2'-Chlorophenyl)-3-(N-n-hexylcarbamoyl)-4-[p-(β-hydroquinonylethyl-phenylazo]-5-pyrazolone

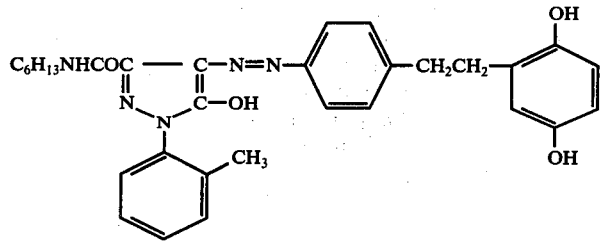

1-(2'-Methylphenyl)-3-(N-n-hexylcarbamoyl)-4-[p-(β-hydroquinonylethyl)-phenylazo]-5-pyrazolone 1-Acetoxy-2-[p-(β-hydroquinoneethyl)-phenylazo]-4-methoxynaphthalene 4-Isobutoxy-2-[p-(β-hydroquinoneethyl)-phenylazo]-1-naphthol 2-{4'-[p-(2'',5''-Dihydroxyphenethyl)-phenylazo]-α-naphthylazo}-4-methoxy-1-naphthol 2-{4'-[p-(2'',5''-Dihydroxyphenethyl)-phenylazo]-α-naphthylazo}-4-methoxy-1-naphthol 4-[p-(2',5'-Dihydroxyphenyl)-phenylazo]-5-acetamido-1-naphthol 4-[p-(2',5'-Dihydroxyphenethyl)-phenylazo]-5-benzamido-1-naphthol 2-[p-(2',5'-Dihydroxy-4'-methylphenethyl)-phenylazo]-4-propoxy-1-naphthol 2-[p-(2',5'-Dihydroxyphenethyl)-phenylazo]-4-acetamido-1-naphthol 2-[p-(2',5'-Dihydroxyphenethyl)-phenylazo]-4-methoxy-1-naphthol 2-[p-(2',5'-Dihydroxyphenethyl)-phenylazo]-4-ethoxy-1-naphthol 2-[p-(2',5'-Dihydroxyphenethyl)-phenylazo]-4-n-propyl-1-naphthol

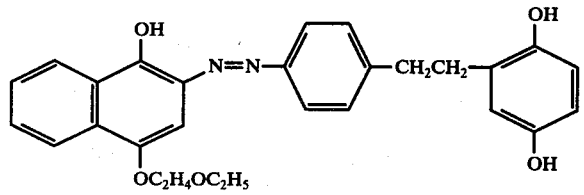

2-[p-(2',5'-Dihydroxyphenethyl)-phenylazo]-4-[1'',4''-dioxahexyl]-1-naphthol 1,4-bis[β-(2',5'-Dihydroxyphenyl)-ethylamino]-anthraquinone 1-Chloro-4-[β-(2',5'-dihydroxyphenyl)-ethylamino]-anthraquinone N-Monobenzol-1,4-bis[β-(3',4'-dihydroxyphenyl)-ethylamino]-anthraquinone N-Monobenzol-1,4-bis[β-(2',5'-dihydroxyphenyl)-ethylamino]-anthraquinone 5,8-Dihydroxy-1,4-bis[(β-hydroquinonyl-α-methyl)-ethylamino]-anthraquinone 1,4-bis(2',5'-Dihydroxyaniline)anthraquinone 1,5-bis(2',5'-Dihydroxyaniline)-4,8-dihydroxyanthraquinone 1,4-bis[(β-Hydroquinonyl-α-ethyl)ethylamino]-anthraquinone 5-Hydroxy-1,4-bis[(β-hydroquinonyl-α-methyl)-ethylamino]-anthraquinone 1-(β-Hydroxy-α-ethyl-ethylamino)-4-(β-hydroquinonyl-α-methyl-ethylamino)-anthraquinone 1-(Butanol-2'-amino)-5,8-dihydroxy-4-hydroquinonylisopropylamino-anthraquinone

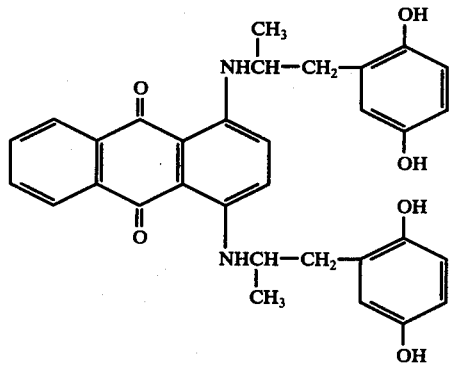

1,4-bis[β-(2',5'-Dihydroxyphenyl)-isopropylamino]anthraquinone

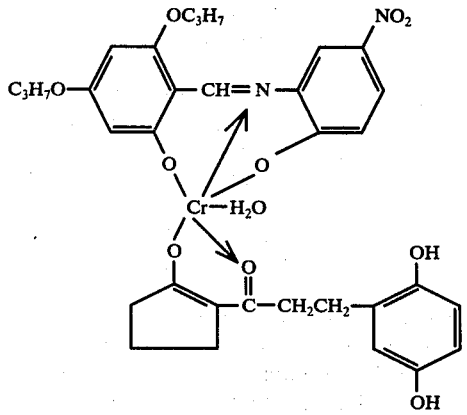

-continued

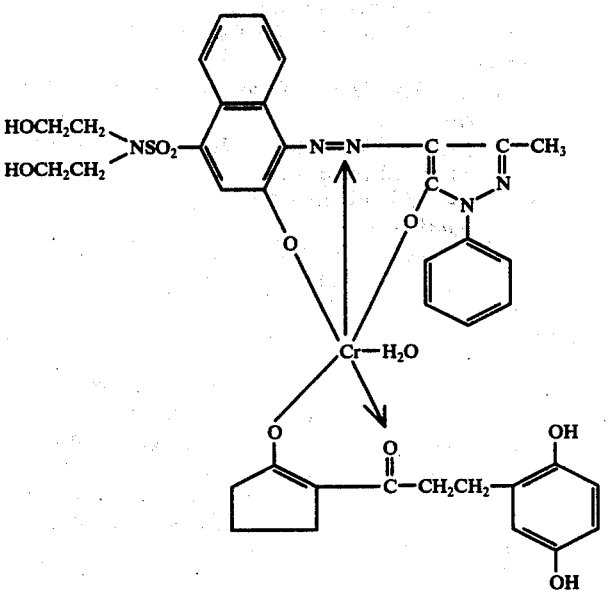

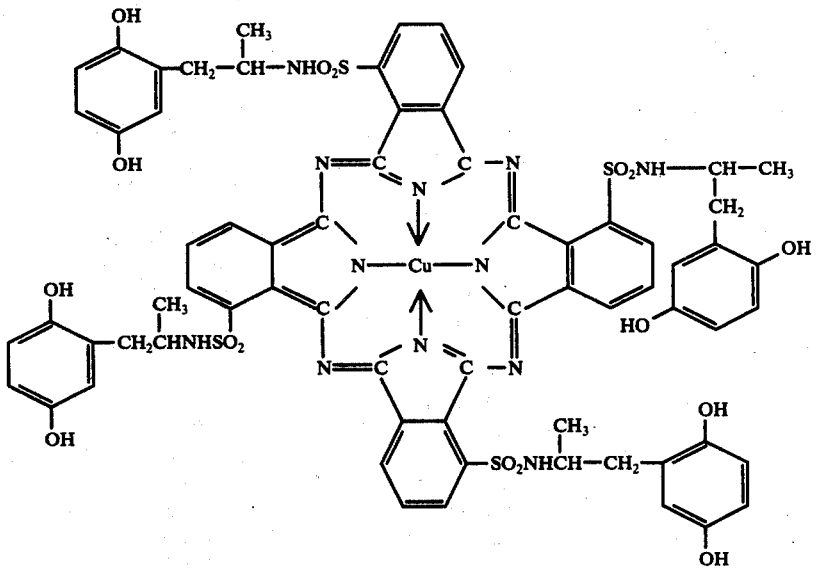

1-Acetoxy-2-{p-[β-(hydroquinonyl)-ethyl]-phenylazo}-4-methoxy-naphthalene

1-Acetoxy-2-{p-[β-(hydroquinonyl)-ethyl]-phenylazo}-4-[(2'-ethoxy)-ethoxy]-naphthalene 1-Acetoxy-2-{p-[β-(hydroquinonyl)-ethyl]-phenylazo}-4-isopropoxynaphthalene

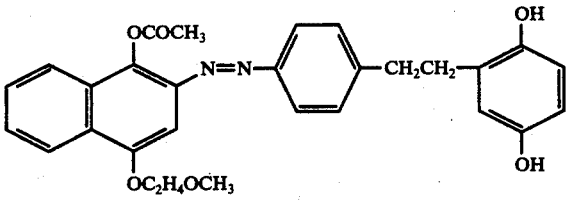

1-Acetoxy-2-{p-[β-(hydroquinonyl)-ethyl]-phenylazo}-4-(1',4'-dioxapentyl)-naphthalene α-[p-(2-Hydroquinonylethyl)-phenylazo]-β-(2'-furyl)-β-acetoxy-acrylonitrile α-[p-(2-Hydroquinonylethyl)-phenylazo]-β-(2'-benzofuranyl)-β-acetoxy-acrylonitrile α-[m-(2-Hydroquinonylethyl)-phenylazo-]-β-(2'-benzofuranyl)-β-acetoxy-acrylonitrile α-[m-(Hydroquinonylmethyl)-phenylazo]-β-(2'-benzofuranyl)-β-acetoxy-acrylonitrile α-[p-(2-Hydroquinonylethyl)-phenylazo]-β-[2'-(5'-bromofuryl)]-β-acetoxy-acrylonitrile α-[p-(2-Hydroquinonylethyl)-phenylazo]-β-[2'-(5'-methoxybenzofuranyl)]-β-acetoxy-acrylonitrile α-[p-(2-Hydroquinonylethyl)-phenylazo]-β-[2'-(5'-bromobenzofuranyl)]-β-acetoxy-acrylonitrile α-[p-(2-Hydroquinonylethyl)-phenylazo]-β-[2'-(3'-methylbenzofuranyl)]-β-acetoxy-acrylonitrile α-Phenylazo-β-[2-(5'-hydroquinonylacetoamidobenzofuranyl)]-β-acetoxy-acetonitrile α-[p-(2-Hydroquinonylethyl)-phenylazo]-β-(2'-benzofuranyl)-β-methoxyacetoxy-arcylonitrile

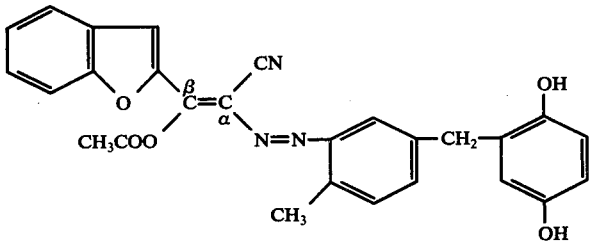

α-[(2-Methyl-5-hydroquinonylmethyl)-phenylazo]-β-(2'-benzofuranyl)-β-acetoxy-acrylonitrile α-[(2-Acetoxy-5-hydroquinonylmethyl)-phenylazo]-β-(2'-furyl)-β-acetoxy-acrylonitrile α-{[2-Acetoxy-5-(2'-hydroquinonylethyl)]-phenylazo}-β-(2-benzofuranyl)-β-acetoxy-acrylonitrile α-[(2-Acetoxy-5-hydroquinonylmethyl)-phenylazo]-β[2'-(5'-bromofuryl)]-β-acetoxy-acrylonitrile α-[(2-Acetoxy-5hydroquinonylmethyl)-phenylazo]-β-[2'-(5'-methoxybenzofuranyl)]-β-acetoxy-acrylonitrile α-[(2-Acetoxy-5-hydroquinonylmethyl)-phenylazo]-β-[2'-(5'-bromobenzofuranyl)]-β-acetoxy-acrylonitrile α-[(2-Acetoxy-5-hydroquinonylmethyl)-phenylazo]-β-[2'-(3'-methylbenzofuranyl)]-β-acetoxy-acrylonitrile α-(2-Acetoxyphenylazo)-β-[2'-(5'-hydroquinonyl-acetoamidobenzofuranyl)]-β-acetoxy-acrylonitrile

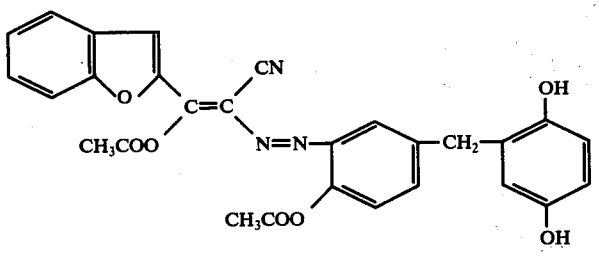

α-[(2-Acetoxy-5-hydroquinonylmethyl)-phenylazo]-β-(2'-benzofuranyl)-β-acetoxy-acrylonitrile 2-[m-(Hydroquinonylmethyl)phenylazo]-3-butyroyloxy-5-methyl-benzothiophene 2-[(2'-Chloro-5-hydroquinonylmethyl)phenylazo]-3-acetoxy-benzothiophene 2-[p-(2'-Hydroquinonylethyl)-phenylazo]-3-acetoxy-benzothiophene 2-[p-(2'-Hydroquinonylethyl)-phenylazo]-3-acetoxy-5-chlorobenzothiophene 2-[(2'-Acetoxy-5'-hydroquinonylmethyl)phenylazo]-3-acetoxy-benzothiophene 2-[(2'-Methyl-5'-hydroquinonylmethyl)-phenylazo]-3-acetoxy-benzothiophene

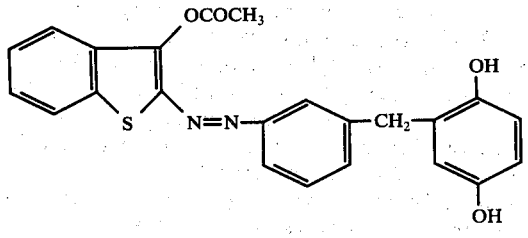

2-[m-(Hydroquinonylmethyl)phenylazo]-3-acetoxy-benzothiophene 1,4-bis(2',5'-Dihydroxyaniline)-9,10-dihydroxy-anthracene 1,5-bis(2',5'-Dihydroxyaniline)-4,8,9,10-tetrahydroxyanthracene 1,4-bis(β-(2',5'-Dihydroxyphenyl)-isopropylamino]-9,10-dihydroxyanthracene 1,4-bis[β-(2',5'-Dihydroxyphenyl)-ethylamino]-9,10-dihydroxyanthracene 1-Chloro-4-[β-(2',5'-dihydroxyphenyl)-ethylamino]-9,10-dihydroxyanthracene 1,4-bis[γ-(2',5'-dihydroxyphenyl)propylamino]-5,8,9,10-tetrahydroxyanthracene 1-[γ-(2',5'-Dihydroxyphenyl)-propylamino]-4-(β-hydroxyethylamino)-5,8,9,10-tetrahydroxyanthracene 1-[(β-Hydroquinonyl-α-methyl)ethylamino]-4-(β-hydroxyethylamino)-5,8,9,10-tetrahydroxyanthracene 1-[β-(2',5'-Dihydroxyphenyl)-ethylamino]-5-(β-hydroxyethylamino)-4,8,9,10-tetrahydroxyanthracene 1,5-bis[(β-Hydroquinonyl-α-methyl)-ethylamino]-4,8,9,10-tetrahydroxyanthracene 1-[β-(2',5'-Dihydroxyphenyl)ethylamino]-4-hexylamino-5,8,9,10-tetrahydroxyanthracene 1,4-bis[(β-Hydroquinonyl-α-ethyl)ethylamino]-5,8,9,10-tetrahydroxyanthracene 1,4-bis[(β-Hydroquinonyl-α-methyl)ethylamino]-5,8,9,10-tetrahydroxyanthracene 1,4-bis[(β-Hydroquinonyl-α-ethyl)ethylamino]-9,10-dihydroxyanthracene 1,4-bis[(β-Hydroquinonyl-α-methyl)-ethylamino]-5,9,10-trihydroxyanthracene 1-(β-Hydroxy-α-ethyl-ethylamino)-4-(β-hydroquinonyl-α-methyl-ethylamino)-9,10-dihydroxyanthracene 1-(Butanol-2'-amino)-4-(β-hydroquinonyl-isopropylamino)-5,8,9,10-tetrahydroxyanthracene 1,8-bis[(β-Hydroquinonyl-α-methyl)ethylamino]-4,5,9,10-tetrahydroxyanthracene N-Monobenzol-1,4-bis[β-(3',4'-dihydroxyphenyl)-ethylamino]-9,10-dihydroxyanthracene N-Monobenzol-1,4-bis[β-(2',5'-dihydroxyphenyl)-ethylamino]-9,10-dihydroxyanthracene 1,4-Diamino-2-[ε-(α-methyl-2',5'-dihydroxyhydrocinnamido)-pentoxy]-9,10-dihydroxyanthracene 1,4-Diamino-2-[ε-(α-ethyl-2',5'-dihydroxyhydrocinnamido)-pentoxy]-9,10-dihydroxyanthracene 1,4-Diamino-2-[ε-(2',5'-dihydoxyhydrocinnamido)-pentoxy]-9,10-dihydroxyanthracene

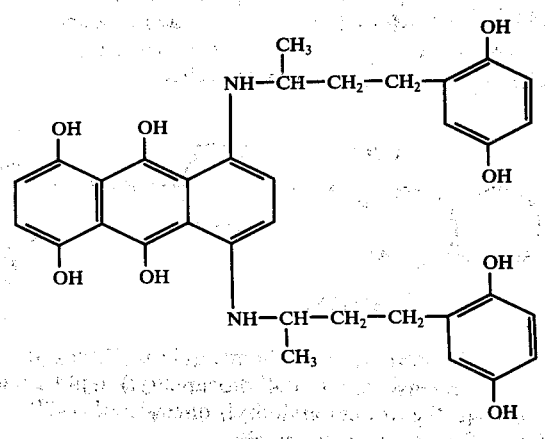

1,4-bis[(γ-Hydroquinonyl-α-methyl)-propylamino]-5,8,9,10-tetrahydroxyanthracene 1-(o-Carboxyphenyl)-3-phenyl-4-[p-(2',5'-trifluoroacetoxy-β-phenylethyl)phenylazo]-5-hydroxypyrazole lactone

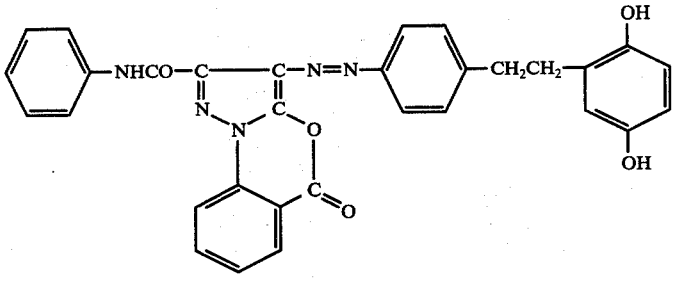

1-(o-Carboxyphenyl)-3-N-phenylcarbamoyl-4-[p-(β-hydroquinonylethyl)phenylazo]-5-hydroxypyrazole lactone α-{[2-Butyroyloxy-5-(2',5'-butyroyloxy-phenylmethyl)]-phenylazo}-β-(2''-benzofuranyl)-β-butyroyloxyacrylonitrile 2-[m-(2',5'-Butyroyloxy-phenylmethyl)phenylazo]-3-butyroyloxybenzothiophene α-[p-(2,5-Butyroyloxy-β-phenylethyl)-phenylazo]-β-(2'-benzofuranyl)-β-butyroyloxy-acetonitrile

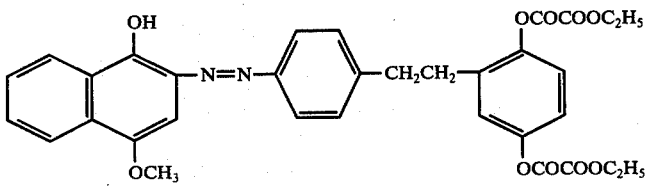

2-[p-(2',5'-Ethoxyoxaloxyphenethyl)phenylazo]-4-methoxy-1-naphthol

If the dye developer which is dissolved by an alkaline processing solution having a high pH and becomes diffusible has a weak activity toward developing silver halide grains, the dye developer is not sufficiently immobilized in the area of the exposure of the silver halide emulsion layer, and therefore, a part of the dye developer diffuses to the image-receiving element whereby a color image is undesirably formed in the highlight portion of the transferred image. When such a dye developer is utilized, therefore, it is desirable to use the dye developer with other types of developers reactive with the silver halide, for example, colorless auxiliary developers. The use of auxiliary developers is known, for example, as disclosed in Japanese Patent Publication Nos. 17383/60, 3736/63, 13837/68, and 29130/64, and British Pat. No. 1,243,539. Specific examples of such auxiliary developers include p-methylamino phenol, 1-phenyl-3-pyrazolidone, phenylhydroquinone, 4'-methylphenylhydroquinone, butylhydroquinone, 2,5-octylhydroquinone, isoamyl gallate, 6,6',7,7'-tetrahydroxy-4,4,4',4'-tetramethyl-bis-2,2'-spirochroman, and 5,6,5',6'-tetrahydroxy-3,3,3',3'-tetramethyl-bis-1,1'-spirochroman. Preferably, such an auxiliary developer is added to the silver halide emulsion layer of the photographic element, the layer containing the dye developer, the interlayer or the outermost layer of the photographic element. However, it can also be incorporated in the processing solution or in the layers forming a spreading sheet, that is, the neutralizing layer and the timing layer (or spacer layer, etc.).

Usually, the dye developer is dispersed finely in a hydrophilic organic colloid, and included in a silver halide emulsion layer or a layer adjacent the emulsion layer. The hydrophilic organic colloid permits the permeation of the alkaline processing solution. The dye developer dispersed as fine particles needs to be dissolved by alkali at a suitable speed, and dispersed in the hydrophilic organic colloid. One specific method for dispersion is to dissolve the dye developer in an organic solvent having a low boiling point and a substantially water-insoluble organic solvent having a high boiling point, adding the solution to an aqueous solution of a hydrophilic organic colloid, and passing the mixture through a colloid mill to form the dye developer into a dispersion of fine particles.

Examples of the high-boiling organic solvents are carboxylic acid esters (such as di-n-butyl phthalate or di-i-octyl phthalate), phosphoric acid esters (such as tri-n-butyl phosphate, tri-n-hexyl phosphate, triphenyl phosphate, or tricresyl phosphate), amides (such as diethyllauryl amide, di-n-butyllauryl amide, or N-n-amylsuccinimide), and phenols (such as 2,4-di-i-amylphenol or 4-n-octylphenol). Other conventional liquid plasticizers can also be used.

Also an organic polymer compatible with the high-boiling organic solvent and the dye developer, for example, a copolymer comprising vinyl chloride as a comonomer unit, a copolymer comprising an alkyl acrylate as a comonomer unit (for example, methyl acrylate, ethyl acrylate or n-butyl acrylate), a copolymer comprising an alkyl methacrylate as a comonomer unit (for example, methyl methacrylate, ethyl methacrylate or n-butyl methacrylate), a copolymer comprising N-vinyl pyrrolidone as a comonomer unit, or a copolymer comprising vinyl acetate as a comonomer unit can be used. Examples of the low-boiling organic solvents are carboxylic acid esters (such as ethyl acetate, isopropyl acetate, n-butyl acetate, 2-(2-butoxyethoxy)-ethyl acetate, or diethyl succinate), ketones (such as cyclohexanone or 2-methylcyclohexanone), and alcohols (such as ethyl alcohol, furfuryl alcohol, or 4-methyl-2-pentanol). Other conventionally known low boiling organic solvents can also be used.

Of the low-boiling organic solvents, those solvents which are relatively readily miscible with water can be easily removed by washing with cold water after cooling and solidification of the dispersion of the fine particles, or by treating the dispersion in an evaporator.

Those solvents having a high vapor pressure can be removed at the time of drying after a coating solution of the dye developer obtained by adding the required additives of the fine particles or a coating solution for a photographic layer obtained by mixing the dispersion with a silver halide photographic emulsion has been coated on a support.

If a small amount of an organic solvent which has a high boiling point and can be mixed with water in any desired proportion (for example, N,N-dimethylformamide or N-methyl pyrrolidone) is conjointly used with the above high-boiling and low-boiling solvents, an organic solvent solution of the dye developer can be prepared within a short period of time. In particular, this procedure of preparation is effective for dispersing an anthraquinonic dye developer. The dispersion of the fine particles of the dye developer becomes unstable upon standing for a long time as such, or upon standing for long periods of time in the form of solidified hydrophilic organic colloid, or when the colloid film coated on the support and dried is allowed to stand under high humidity conditions (usually higher than 75% RH). As a result, crystals of the dye developer are formed, or the particles of the dispersed substance become larger, or the high-boiling organic solvent bleeds out onto the surface of the coating. In order to eliminate the lack of stability of the dispersion, a dispersion of a polymer such as a homopolymer or copolymer of an acrylic acid ester or methacrylic acid ester is added to the dispersion of the dye developer before the coating of the dispersion. When a dye developer is relatively readily soluble in a high-boiling organic solvent, a stable dispersion can be obtained without using the low-boiling organic solvent. Furthermore, when a dye developer relatively readily soluble in a homopolymer or copolymer of an acrylic acid ester or methacrylic acid ester is used, it is possible to dissolve the dye developer in the low-boiling organic solvent and the above-described polymer without using a high-boiling organic solvent to obtain a dispersion in a usual manner. Alternatively, in this case, the dispersion is prepared in a usual manner, and before the dispersion is coated, a polymer dispersion containing the above emulsion polymerization product is added to the dispersion thereby to form a stable dispersion of the dye developer. By the combined use of such an emulsion polymerization product, the diameter of most of the dispersed particles of the dye developer can be reduced to a size of not more than about 0.1 micron.

In the above description, the term "high-boiling organic solvent" designates a solvent having a boiling point above about 175° C and the term "low-boiling solvent" designates a solvent having a boiling point below about 175° C.

In the photographic element, the dye developer is present adjacent the silver halide in the emulsion layer. A yellow dye developer is present in a hydrophilic organic colloid layer immediately adjacent a blue-sensitive emulsion layer or incorporated in the blue-sensitive emulsion layer. Similarly, a magenta dye developer is present adjacent the silver halide in a green-sensitive emulsion layer, and a cyan dye developer is present adjacent the silver halide in a red-sensitive emulsion layer. In order to provide the dye developer side by side with the silver halide, fine particles containing the dye developer and the silver halide grains, preferably microcapsules containing these fine particles, can be formed. In this case, three red-sensitive, green-sensitive and blue-sensitive emulsions of different light-sensitive wavelength regions can be dispersed in the form of microcapsules, and formed into a mixed packet.

It is necessary that the dye developer combined with a silver halide emulsion having a predetermined light-sensitive wavelength region should be so devised that the dye developer is used only for that silver halide emulsion, and does not act on silver halide emulsions having light-sensitivity in other wavelength regions. Otherwise, the color of the color photographic image produced has a very low saturated degree. One means for preventing such an interaction between the emulsion layers' is a method of separating silver halide emulsion layers of different light-sensitive wavelength regions by a partition layer. The partition layer can comprise a polymer layer as described, for example, in Japanese Patent Publication Nos. 4292/64, 18435/70 and 47606/72. In order to enhance the action of this partition layer, a tanning developer such as a long chain alkyl-substituted hydroquinone can be added to the emulsion layer, as disclosed in Japanese Patent Publication No. 10240/59.

It is important that development should be rapidly effected in each of the emulsion layers separated from each other by the partition layer. In order to achieve this, an auxiliary developer or an onium compound can be caused to act on the silver halide emulsion layer. For example, the onium compounds disclosed in Japanese Patent Publication No. 1738/64, and U.S. Pat. Nos. 2,648,604; 2,271,622; 2,275,727; and 2,271,623 are effective for this purpose. More particularly, quaternary ammonium salts such as tetraethyl ammonium bromide, N-ethyl pyridinium bromide, 1-phenethyl-2-picolium bromide, 1-benzyl-4-ethyl pyridinium bromide, 1-benzyl-2-picolium bromide or 1-ethyl-2-methyl-3-phenethyl benzimidazolium bromide can be employed. When the onium compound is used as a salt, the associated anion can be an organic acid anion or inorganic acid anion of various kinds. Usually, such a compound can be used after addition to an alkaline processing solution having a high pH. An especially effective concentration is about 0.1 to 15% by weight.

The alkaline processing solution having a high pH permeates into the photographic element to dissolve the dye developer and the colorless auxiliary developer contained in the photographic element and to enable the developer to diffuse into the photographic layer, and then the developer reacts with the silver halide emulsion having a latent image in the exposed area of the photographic element. As a result, the dye developer is fixed in the photographic layer as the function of the amount of exposure. On the other hand, the developer does not react with the silver halide emulsion in the unexposed area (without a latent image) of the photographic element, and consequently, the unreacted diffusible dye developer is distributed imagewise in the photographic element. At least a part of the imagewise distribution of the unreacted dye developer is transferred by imbibition to a mordanting agent spread between the mordanting layer or spreading sheet and the photosensitive element, thereby to form a visible image. The amount of the dye developer diffused to the mordanting agent and transferred is determined as the function of the transferring time.

In a photographic film unit where the image-receiving element does not have to be stripped from the photosensitive element, the silver halide emulsion layer of the photographic element should be masked after processing. In order to achieve this, an opacifying agent must be incorporated in the outermost layer of the photographic element or in the outermost emulsion layer, or in the processing solution. The opacifying agent is helpful in preventing re-exposure of the photographic film unit when it is withdrawn from the camera after processing.

In a photographic film unit prepared so that an observer can see the image from the side of the transparent support of the image-receiving layer, at least one of the opacifying agents should be a white pigment. The type and the amount of the opacifying agent are preferably such that damage of the white background does not occur. Especially probably, at least one kind of white pigment is selected from barium sulfate, zinc oxide, titanium dioxide, barium stearate, silicon dioxide, aluminum oxide, and kaolin. In order to prevent re-exposure, preferably a coating containing a colored substance such as colloidal silver, carbon black, graft carbon or an organic chelate pigment is formed on the coating layer located on the photographic element. As another method, it is desirable to add to the alkaline processing solution an indicator dye which is colored above the pKa of the dye and is colorless below the pKa of the dye. Especially when the photographic element is exposed through the image-receiving material or spreading sheet, it is desirable to incorporate an indicator dye illustrated, for example, in Japanese Laid-Open Patent Publications Nos. 26/72, 27/72 and 28/72 in the processing solution.

The support used for the photographic element is a material which is substantially water-impermeable and is substantially dimensionally stable. Examples of suitable supports are transparent film supports selected from polymers of vinyl derivatives, polyamides, polyesters, polycarbonates, and cellulose esters derived from acetic acid, propionic acid, butyric acid and nitric acid, film supports obtained by mixing the above materials with carbon black or titanium dioxide and then molding the mixture, or paper supports obtained by laminating or coating the above-described polymers. A suitable coating amount of the silver halide ranges from about 0.03 to 0.06 mol/m$^2$. A suitable molar ratio of the silver halide to the dye developer ranges from about 1:3 to 1:20.

The support used for the image-receiving element or spreading sheet is a material which is substantially water-impermeable and is substantially dimensionally stable. The same materials as in the case of the photographic element can be used, but in order to prepare the spreading sheet, the support should be transparent.

The support on which the acid polymer is coated as a neutralizing layer should be a material which is not permeated by an organic solvent. Preferably, the support is, for example, a paper sheet laminated with a polyamide, a polyester or polyethylene, or a paper sheet coated with a cellulose ester.

It is desirable that a small amount of a light-shielding substance for preventing light-piping be incorporated in these supports.

It will be readily understood from the above description that in the present specification, the image-receiving material or element is one having a structure wherein a mordanting layer is, or is to be, formed on a spreading sheet.

The photographic elements composed of a number of silver halide photographic emulsion layers in combination with the dye image forming material in accordance with this invention can contain various silver halide emulsions, spectral sensitizers, sensitizers, antifoggants, stabilizers, hardening agents and coating assistants.

The silver halide emulsion is usually prepared by mixing a solution of a water-soluble silver salt (for example, silver nitrate) with a solution of a water-soluble halogen salt (for example, potassium bromide) in the presence of a solution of a water-soluble, polymer such as gelatin. Examples of silver halides that can be used include not only silver chloride and silver bromide, but also mixed silver halides such as silver chlorobromide, silver iodobromide or silver chloroiodobromide. It is desirable to use a silver iodobromide containing not more than about 15 mol% of silver iodide. A suitable grain size of the silver halide particles as measured using the projected area method or by the number average method preferably ranges from about 0.04 $\mu$ to 2 $\mu$.

The shape of the silver halide grains can be any of a cubic system, an octagonal crystal or a mixed crystal shape.

The silver halide grains can be prepared in accordance with conventional procedures. It is also effective to use a so-called single or double jet method, or a control jet method. Alternatively, two or more silver halide photographic emulsions prepared separately can be mixed. The crystal composition of the silver halide grains can be uniform throughout, or can be layered with a difference between the interior and the exterior. Also, a so-called conversion type, as described, for example, in British Pat. No. 635,841 and U.S. Pat. No. 3,622,318 can be used as the silver halide. Other examples include a type in which a latent image is formed mainly on the surface, or an internal latent image type wherein a latent image is formed inside the grains. These photographic emulsions can be prepared by various methods such as the ammonia method, the neutral method, or the acid method which are generally well known and described, for example, in Mees and James, *The Theory of the Photographic Process,* Macmillan, and Grafkides, *Photographic Chemistry,* Fountain Press. After formation, these silver halide grains are rinsed with water in order to remove by-product water-soluble salts (for example, potassium nitrate when silver bromide is prepared from silver nitrate and potassium bromide) from the system, and then heat-treated in the presence of a chemical sensitizer to increase the sensitivity of the grains without increasing their sizes. This general method is also well known and described in Mees and James, supra, and Grafkides, supra.

Examples of hydrophilic colloids which can be used as a vehicle for the silver halide include gelatin, colloidal albumin, casein, cellulose derivatives such as carboxymethyl cellulose or hydroxymethyl cellulose, agar, sodium alginate, saccharide derivatives such as starch derivatives, and synthetic hydrophilic colloids such as polyvinyl alcohol, poly-N-vinyl pyrrolidone, an acrylic acid copolymer, polyacrylamides or the derivatives thereof. If desired, a mixture of at least two of these colloids compatible with each other can be used. Of these hydrophilic colloids, gelatin is most commonly used. The gelatin may be replaced partly or completely by a synthetic polymeric substance. Alternatively, gelatin derivatives obtained by treating a functional group contained in the gelatin molecule, such as an amino, imino, hydroxy or carboxyl group, with a compound containing a group capable of reacting with such a functional group, or graft polymers obtained by bonding a molecular chain of another polymeric substance to the gelatin molecule can be used.

Examples of compounds which can be used for preparing the gelatin derivatives are the isocyanates, acid chlorides and acid anhydrides disclosed in U.S. Pat. No. 2,614,928, the acid anhydrides disclosed in U.S. Pat. No. 3,118,766, the bromoacetic acids described in Japanese Patent Publication No. 5514/64, the phenylglycidyl ethers described in Japanese Patent Publication No. 26845/67, the vinyl sulfone compounds disclosed in U.S. Pat. No. 3,132,945, the N-allyl vinylsulfonamides disclosed in British Pat. No. 861,414, the maleimide compounds disclosed in U.S. Pat. No. 3,186,846, the acrylonitriles disclosed in British Pat. No. 2,594,293, the polyalkylene oxides disclosed in U.S. Pat. No. 3,312,553, the epoxy compounds disclosed in Japanese Patent Publication No. 26845/67, the acid esters disclosed in U.S. Pat. No. 2,763,639, and the alkane sultones disclosed in British Pat. No. 1,033,189. Grafting polymers to be grafted onto gelatin are disclosed, for example, in U.S. Pat. Nos. 2,831,767 and 2,956,884, *Polymer Letters,* 5, 595 (1967), *Phot. Sci. Eng.,* 9, 148 (1965), and *J. Polymer Sci.,* A-1, 9, 3199 (1971). Generally, a wide range of polymers or copolymers of the so-called vinyl monomers such as acrylic acid, methacrylic acid, or derivatives thereof such as their esters, amides or nitriles can be used. Hydrophilic vinyl polymers having some compatibility with gelatin, such as polymers or copolymers of acrylic acid, acrylamide, methacrylamide, hydroxyalkyl acrylates, or hydroxyalkyl methacrylates, are especially desirable.

Sensitizing dyes for silver halides are disclosed, for example, in U.S. Pat. Nos. 2,526,632; 2,503,776; 2,493,748; and 3,384,486; and Japanese Patent Publication Nos. 392/65, 4933/68, 4936/68; 25831/70, and 1999/71, and include, for example, cyanines, merocyanines, tri- or tetra-cyclic cyanines, holopolar cyanines, hemicyanines, oxonols, and hemioxonols. The cyanine dyes can contain a thiazoline, oxazoline, pyroline, pyridine, oxazole, thiazole, selenazole, or imidazole ring, for example. The nucleus can contain, for example, an alkyl, alkylene, hydroxyalkyl, sulfoalkyl, carboxyalkyl, aminoalkyl or enamine group, or can form a fused ring. The above nucleus can also contain a substituent such as halogen, phenyl, alkyl, cyano or alkoxy. The sensitizing dyes can be a symmetrical or asymmetrical type, or can contain alkyl, phenyl, enamine or a heterocyclic ring in the chain.

The merocyanines can contain an acidic nucleus such as a thiohydantoron, rhodanine, oxazolinedione, thiazolinedione, barbituric acid, thiazolinone, or malononitrile nucleus in addition to the above-described basic ring. These acidic nuclei can also contain alkyl, alkylene, phenyl, carboxyl, alkyl, sulfoalkyl, hydroxyalkyl, alkoxyalkyl, alkylamino, or heterocyclic rings, etc., as substitutents. If desired, these dyes can be used in combination.

Sensitizers can be added to the silver halide emulsions to increase their sensitivity. Examples of useful sensitizers are the quaternary ammonium salts described in U.S. Pats. Nos. 2,271,623; 2,288,226 and 2,224,864 and Belgian Pat. No. 620,339, the polyethylene glycol derivatives described in U.S. Pat. No. 2,708,162, the thioether compounds described in U.S. Pat. Nos. 3,046,132 to 3,046,135 and the diketone compounds disclosed in Belgian Pat. Nos. 618,139 and 618,140 and British Pat. No. 939,357.

Examples of antifoggants or stabilizers that can be added to the photographic element include the mercury compounds disclosed in U.S. Pat. Nos. 2,728,663 to 2,728,667 and Japanese Patent Publication Nos. 22063/64 and 7570/68, the benzothiazolium salts disclosed in U.S. Pat. No. 2,131,038, and Japanese Patent Publication No. 21847/67, the nitroazoles (e.g., nitrobenzimidazole or nitrobenzotriazole) disclosed in British Pat. No. 403,789, the phenylmercaptotetrazole disclosed in U.S. Pat. No. 2,403,927, the mercaptopyrimidine disclosed in British Pat. No. 452,043, the thiosalicylic acid disclosed in U.S. Pat. No. 2,377,375, and the mercapto compounds (e.g., mercaptotetrazaindene, mercaptobenzothiazole, mercaptobenzimidazole, mercaptotriazine, mercaptothiazole, or mercaptobenzothiazole) disclosed in British Pat. No. 893,428. Known nitrogen-containing heterocyclic compounds having an anti-fogging action, such as the azaindene compounds (especially,1,3,3a,7-tetraaza-4-hydroxy-6-methylindene) disclosed in *Zietschrift fur Wissenschaftliche Photographie,* 47, 2–27 (1952), the urazoles disclosed in U.S. Pat. No. 2,708,162, or the urazoles disclosed in U.S. Pat. No. 2,708,161 can also be used. Furthermore, the benzenesulfinic acid or benzenethiosulfonic acid disclosed in U.S. Pat. No. 2,394,198, the benzenesulfinic acid amide disclosed in Japanese Patent Publication No. 4136/68, or the saccharide mercaptal disclosed in Japanese Patent Publication No. 8743/72 can also be added to the photographic element. In addition, in order to prevent fog by metallic ions, various chelating agents disclosed, for example, in U.S. Pat. No. 2,691,588, British Pat. No. 623,488, and Japanese Patent Publication No. 4941/68 can be added.

Examples of useful hardening agents are aldehydes, protected aldehydes (for example, protected with acetals, ketones, carboxylic acids, or carbon derivatives), sulfonic acid esters, sulfonyl halides, vinyl sulfonyl ethers, active halogen compounds, epoxy compounds, aziridines, active olefins, isocyanates, carbodiimide, or oxidized polysaccharides such as dialdehyde starch. Additional examples of hardening agents are described in U.S. Pat. Nos. 3,232,764; 3,288,775; 2,732,303; 3,635,718; 3,232,763; 2,732,316; 2,586,168; 3,103,437; 3,017,280; 2,983,611; 2,725,294; 2,725,295; 3,100,704; 3,091,537; 3,543,292 and British Pat. Nos. 974,723; 1,167,207 and 994,869, etc.

Various known surface active agents can be added for the purpose of assisting in coating. Examples of such coating assistants include saponin, the polyethylene glycol ethers disclosed in U.S. Pat. No. 2,831,766, the acylated taurine disclosed in U.S. Pat. No. 2,739,891, the maleopimelates disclosed in U.S. Pat. No. 2,823,123, and the compounds disclosed in Japanese Patent Publication Nos. 1024/68, 8401/69 and 21983/71.

The silver halide emulsion so prepared can be coated on the above-described support using a dip-coating, air knife-coating, or curtain-coating method, or an extrusion coating method using a hopper of the type described in U.S. Pat. No. 2,681,294. If desired, two or more emulsion layers can be coated simultaneously in accordance with the method disclosed in U.S. Pat. No. 2,761,791 or British Pat. No. 837,095.

The following materials can also be added to the diffusion transfer photographic material and the alkaline processing solution used in this invention.

In order to whiten the white background of the transferred color image, a fluorescent brightening agent such as a triazine stilbene-type or ureidocoumarin-type bleaching agent can be incorporated in the white light-shielding agent or in the processing solution or as a separate layer near the light-shielding agent. On the other hand, in order to prevent the fading of the color image by light, it is desirable to incorporate an ultraviolet absorber, such as 2-(2-hydroxy-4-t-butylphenyl)-benzotriazole, in the timing layer, the neutralizing layer or the support for the spreading sheet, or as a separate layer near the support.

Stopping the development of the silver halide after a certain period of time is also an important technique in this type of process. Thus, in the present invention, too, a mercapto azole, an iodine ion generator, or thiobarbituric acid, etc. disclosed, for example, in Japanese Patent Publication Nos. 9586/64 and 10386/66 can be incorporated in a coating layer of the spreading sheet or in the photographic element.

The image-receiving material in accordance with this invention, combined with the above-described photographic element and processing solution, can be used together with photographic devices disclosed, for example, in U.S. Pat. Nos. 3,382,788; 3,421,423; 3,421,664; 3,498,197; 3,709,122; 3,714,879; 3,715,961; 3,722,389; and 3,727,529.

The following Examples are given to further illustrate the present invention in greater detail. Unless otherwise indicated, all parts, percents, ratios and the like are by weight.

EXAMPLE 1

Polyvinyl alcohol samples of various degrees of polymerization (600 to 1800) and degrees of saponification (80 to 98 mol%) were each dissolved in water to form a 10% by weight aqueous solution of each of these samples, respectively. 5 g of a 2% aqueous solution of each of Compounds 1 to 11 as a cross-linking agent was added to 35 g of each of these polyvinyl alcohol solutions, and then 20 g of water, or 16 g of water and 4 g of a 1% aqueous solution of phosphoric acid or sulfuric acid as a cross-linking promotor, were added to adjust the total amount of the solution to 60 g.

Each of the solutions so prepared was uniformly coated on a cellulose triacetate film support in a dry thickness of 5 microns. The degree of swelling of the resulting polyvinyl alcohol film in water and in a 1N aqueous solution of potassium hydroxide was measured. The degree of swelling was expressed as the ratio of the thickness of the film swollen in the course of 3 minutes in the above liquid to the dry thickness. The results obtained are shown in the following Tables 1 to 3. The measurement was made at a temperature of 20° C. When the cross-linking agent was not used, an infinite degree of swelling was obtained.

TABLE 1

(Acidic Promotor Not Used)

| Polyvinyl Alcohol | | | Polymethylol Compound Number | | | | | | | | | |
|---|---|---|---|---|---|---|---|---|---|---|---|---|
| Degree of Saponification | Degree of Polymerization | Solution | 1 | 2 | 3 | 4 | 5 | 6 | 7 | 8 | 9 | 10 |
| (mol %) | | | | | | | | | | | | |
| 98 | 1800 | $H_2O$ | 6.8 | 5.6 | 8.0 | 6.9 | 6.0 | 8.8 | 9.0 | 9.3 | 8.5 | 9.1 |
| | | 1N KOH | 6.9 | 5.8 | 8.2 | 7.0 | 5.9 | 9.0 | 8.4 | 9.6 | 8.4 | 9.4 |
| 98 | 1100 | $H_2O$ | 7.0 | 5.8 | 7.9 | 7.2 | 5.9 | 8.9 | 9.1 | 9.6 | 8.6 | 9.0 |
| | | 1N KOH | 7.4 | 5.9 | 8.4 | 6.9 | 6.3 | 9.4 | 8.8 | 9.6 | 8.8 | 9.2 |
| 98 | 600 | $H_2O$ | 6.7 | 5.6 | 7.8 | 7.0 | 5.8 | 9.0 | 8.8 | 9.4 | 8.4 | 9.0 |
| | | 1N KOH | 7.0 | 5.5 | 8.2 | 7.1 | 6.1 | 8.6 | 8.9 | 9.8 | 9.2 | 9.1 |
| 88 | 1800 | $H_2O$ | 6.9 | 5.4 | 8.1 | 7.0 | 6.2 | 8.7 | 9.1 | 9.4 | 8.6 | 9.2 |
| | | 1N KOH | 6.7 | 5.9 | 8.3 | 7.1 | 5.7 | 8.6 | 9.1 | 9.7 | 8.2 | 9.3 |
| 88 | 1100 | $H_2O$ | 7.0 | 5.6 | 8.3 | 7.2 | 6.5 | 8.6 | 9.3 | 9.3 | 8.9 | 9.1 |
| | | 1N KOH | 6.7 | 5.5 | 8.7 | 7.3 | 5.9 | 8.4 | 9.0 | 9.4 | 8.4 | 9.5 |
| 88 | 600 | $H_2O$ | 7.2 | 5.8 | 8.8 | 7.6 | 6.7 | 8.7 | 9.6 | 9.8 | 9.0 | 9.5 |
| | | 1N KOH | 7.0 | 5.8 | 9.0 | 7.5 | 6.4 | 8.6 | 9.4 | 9.8 | 8.7 | 9.6 |
| 80 | 1800 | $H_2O$ | 7.0 | 5.6 | 8.9 | 7.4 | 6.9 | 8.5 | 9.5 | 9.7 | 8.8 | 9.7 |
| | | 1N KOH | 6.8 | 5.9 | 9.1 | 7.5 | 6.5 | 8.4 | 9.5 | 9.4 | 8.6 | 9.8 |
| 80 | 1100 | $H_2O$ | 7.2 | 5.5 | 9.0 | 7.3 | 6.8 | 8.4 | 9.4 | 8.9 | 9.4 | 9.9 |
| | | 1N KOH | 6.9 | 6.0 | 9.0 | 7.4 | 6.6 | 8.5 | 9.7 | 8.7 | 8.7 | 10.0 |
| 80 | 600 | $H_2O$ | 7.0 | 5.7 | 9.0 | 7.6 | 7.0 | 8.7 | 9.6 | 9.9 | 8.9 | 9.8 |
| | | 1N KOH | 6.9 | 5.6 | 9.4 | 7.6 | 6.7 | 8.3 | 9.6 | 9.5 | 8.8 | 9.9 |

TABLE 2

(Phosphoric Acid Used as Acidic Promotor)

| Polyvinyl Alcohol | | | Polymethylol Compound Number | | | | | | | | | |
|---|---|---|---|---|---|---|---|---|---|---|---|---|
| Degree of Saponification | Degree of Polymerization | Solution | 1 | 2 | 3 | 4 | 5 | 6 | 7 | 8 | 9 | 10 |
| (mol %) | | | | | | | | | | | | |
| 98 | 1800 | $H_2O$ | 3.3 | 3.4 | 4.0 | 3.6 | 4.5 | 5.3 | 6.3 | 6.2 | 6.1 | 5.7 |
| | | 1N KOH | 3.2 | 3.0 | 3.9 | 3.5 | 4.3 | 5.2 | 6.2 | 6.1 | 5.9 | 5.9 |
| 98 | 1100 | $H_2O$ | 3.4 | 3.5 | 4.2 | 4.0 | 4.6 | 5.4 | 6.3 | 6.1 | 6.0 | 5.8 |
| | | 1N KOH | 3.5 | 3.3 | 4.0 | 3.9 | 4.6 | 5.4 | 6.6 | 6.3 | 6.2 | 6.0 |
| 98 | 600 | $H_2O$ | 3.6 | 3.7 | 4.5 | 4.3 | 4.9 | 5.7 | 6.7 | 6.4 | 6.3 | 6.1 |
| | | 1N KOH | 3.8 | 3.6 | 4.4 | 3.9 | 5.0 | 5.9 | 6.5 | 6.4 | 6.5 | 6.3 |
| 88 | 1800 | $H_2O$ | 3.4 | 3.3 | 4.0 | 3.5 | 4.6 | 5.4 | 6.4 | 6.5 | 6.2 | 5.3 |
| | | 1N KOH | 3.4 | 3.2 | 3.7 | 3.4 | 4.3 | 5.4 | 6.3 | 6.6 | 6.3 | 5.7 |
| 88 | 1100 | $H_2O$ | 3.5 | 3.6 | 4.3 | 4.2 | 4.4 | 5.6 | 6.2 | 6.0 | 5.9 | 6.0 |
| | | 1N KOH | 3.5 | 3.4 | 4.2 | 4.2 | 4.5 | 5.7 | 6.3 | 6.5 | 5.5 | 5.9 |
| 88 | 600 | $H_2O$ | 3.7 | 3.8 | 4.4 | 4.2 | 4.9 | 5.9 | 6.9 | 6.3 | 6.2 | 6.0 |
| | | 1N KOH | 3.9 | 3.5 | 4.6 | 3.8 | 5.0 | 5.6 | 6.2 | 6.2 | 6.3 | 6.5 |
| 80 | 1800 | $H_2O$ | 3.4 | 3.4 | 4.0 | 3.4 | 4.6 | 5.8 | 6.5 | 6.6 | 6.0 | 5.5 |
| | | 1N KOH | 3.6 | 3.2 | 3.7 | 3.6 | 4.7 | 5.9 | 6.1 | 6.4 | 6.4 | 5.6 |
| 80 | 1100 | $H_2O$ | 3.7 | 3.6 | 4.3 | 4.3 | 4.6 | 5.7 | 6.3 | 6.3 | 5.8 | 5.8 |
| | | 1N KOH | 3.8 | 3.5 | 4.3 | 4.4 | 4.4 | 5.8 | 6.2 | 6.6 | 6.0 | 6.0 |
| 80 | 600 | $H_2O$ | 3.9 | 3.8 | 4.5 | 4.6 | 4.7 | 5.9 | 6.5 | 6.6 | 6.3 | 6.1 |
| | | 1N KOH | 3.9 | 3.8 | 4.6 | 4.7 | 4.5 | 5.9 | 6.5 | 6.7 | 6.9 | 6.4 |

TABLE 3

(Sulfuric Acid Used as Acidic Promotor)

| Polyvinyl Alcohol | | | Polymethylol Compound Number | | | | | | | | | |
|---|---|---|---|---|---|---|---|---|---|---|---|---|
| Degree of Saponification | Degree of Polymerization | Solution | 1 | 2 | 3 | 4 | 5 | 6 | 7 | 8 | 9 | 10 |
| (mol %) | | | | | | | | | | | | |
| 98 | 1800 | $H_2O$ | 2.4 | 2.5 | 3.0 | 3.1 | 3.3 | 4.1 | 5.0 | 5.0 | 5.0 | 4.6 |
| | | 1N KOH | 2.4 | 2.6 | 3.1 | 3.3 | 3.4 | 4.3 | 4.9 | 4.4 | 4.5 | 4.7 |
| 98 | 1100 | $H_2O$ | 2.3 | 2.6 | 3.1 | 3.2 | 3.4 | 4.0 | 4.8 | 4.8 | 4.7 | 4.5 |
| | | 1N KOH | 2.5 | 2.5 | 3.0 | 3.2 | 3.6 | 4.4 | 4.6 | 4.7 | 4.8 | 4.8 |
| 98 | 600 | $H_2O$ | 2.5 | 2.5 | 3.0 | 3.1 | 3.5 | 4.2 | 4.9 | 4.9 | 4.7 | 4.6 |
| | | 1N KOH | 2.5 | 2.6 | 3.1 | 3.3 | 3.5 | 4.6 | 5.1 | 4.7 | 4.8 | 4.9 |
| 88 | 1800 | $H_2O$ | 2.5 | 2.4 | 3.0 | 3.3 | 3.4 | 4.3 | 4.8 | 5.0 | 4.8 | 4.6 |
| | | 1N KOH | 2.6 | 2.6 | 3.1 | 3.1 | 3.5 | 4.5 | 5.0 | 4.8 | 4.7 | 5.0 |
| 88 | 1100 | $H_2O$ | 2.5 | 2.5 | 3.1 | 3.4 | 3.5 | 4.4 | 4.9 | 4.9 | 4.9 | 4.7 |
| | | 1N KOH | 2.6 | 2.5 | 3.1 | 3.3 | 3.5 | 4.4 | 4.9 | 5.1 | 5.0 | 5.2 |
| 88 | 600 | $H_2O$ | 2.6 | 2.7 | 3.2 | 3.5 | 3.6 | 4.5 | 5.0 | 4.9 | 4.7 | 4.8 |
| | | 1N KOH | 2.9 | 2.4 | 3.3 | 3.5 | 3.7 | 4.6 | 5.1 | 5.3 | 5.2 | 5.3 |
| 80 | 1800 | $H_2O$ | 2.3 | 2.4 | 3.2 | 3.2 | 3.3 | 4.1 | 4.8 | 4.6 | 4.5 | 4.6 |
| | | 1N KOH | 2.6 | 2.1 | 3.1 | 3.2 | 3.4 | 4.6 | 4.8 | 5.0 | 5.1 | 5.0 |
| 80 | 1100 | $H_2O$ | 2.3 | 2.5 | 3.4 | 3.1 | 3.2 | 4.0 | 4.6 | 4.5 | 4.3 | 4.4 |
| | | 1N KOH | 2.5 | 2.2 | 3.2 | 3.1 | 3.3 | 4.4 | 4.5 | 5.2 | 5.0 | 4.8 |
| 80 | 600 | $H_2O$ | 2.4 | 2.6 | 3.5 | 3.3 | 3.4 | 4.2 | 4.7 | 4.4 | 4.4 | 4.6 |
| | | 1N KOH | 2.6 | 2.6 | 3.4 | 3.3 | 3.2 | 4.2 | 4.6 | 5.0 | 4.7 | 4.7 |

When the cross-linking agents used in the Examples of U.S. Pat. No. 3,586,503 were used instead of the cross-linking agent used in this Example, the polyvinyl alcohol film exhibited higher degrees of swelling.

EXAMPLE 2

Polyvinyl alcohol samples having various degrees of polymerization (600 to 1800) and a degree of saponification of 88 mol% were each dissolved in water to form a 10% by weight aqueous solution of each, respectively.

1.4 g of poly-4-vinyl pyridine and 1 ml of acetic acid were added to 28 g of each of these polyvinyl alcohol solutions, and 5 g of a 2% by weight aqueous solution of each of Compounds 1 to 11 as a cross-linking agent was added, followed by addition of 29.6 g of water, or 25.6 g of water and 4 g of a 1% by weight aqueous solution of phosphoric acid or sulfuric acid as a cross-linking promotor to adjust the total amount of the solution to 60 g. Each of the solutions so prepared was coated uniformly on a cellulose triacetate film support in a dry thickness of 5 microns.

The degree of swelling of the polyvinyl alcohol film so coated in water and in a 1N aqueous solution of potassium hydroxide was measured. The degree of swelling was expressed as the ratio of the thickness of the polyvinyl alcohol film swollen in the course of 3 minutes in the liquid to the dry thickness. The results obtained are shown in the following Table 4. The measurement was at a temperature of 20° C. An infinite degree of swelling was obtained for a comparison sample containing no cross-linking agent.

TABLE 4

| Polyvinyl Alcohol | Acidic Promotor | Solution | Polymethylol Compound Number | | | | | | | | | |
|---|---|---|---|---|---|---|---|---|---|---|---|---|
| | | | 1 | 2 | 3 | 4 | 5 | 6 | 7 | 8 | 9 | 10 |
| 1800* | None | $H_2O$ | 6.1 | 6.3 | 7.0 | 6.5 | 7.3 | 7.4 | 7.3 | 8.2 | 8.3 | 9.0 |
| | " | 1N KOH | 3.4 | 3.6 | 3.3 | 3.9 | 3.8 | 3.6 | 3.7 | 3.9 | 4.0 | 4.1 |
| 1100 | " | $H_2O$ | 6.0 | 6.4 | 7.2 | 6.7 | 7.5 | 7.6 | 7.4 | 8.5 | 8.5 | 9.6 |
| | " | 1N KOH | 3.3 | 3.4 | 3.7 | 3.7 | 4.1 | 3.8 | 3.4 | 4.0 | 4.2 | 4.2 |
| 600 | " | $H_2O$ | 6.3 | 6.7 | 7.6 | 7.0 | 7.9 | 7.9 | 8.0 | 9.0 | 8.8 | 10.1 |
| | " | 1N KOH | 3.6 | 3.6 | 3.6 | 3.8 | 7.5 | 4.2 | 3.8 | 4.6 | 4.5 | 4.7 |
| 1800 | $H_3PO_4$ | $H_2O$ | 3.3 | 3.6 | 4.0 | 3.8 | 3.9 | 3.9 | 7.6 | 4.0 | 3.0 | 2.1 |
| | " | 1N KOH | 3.2 | 3.4 | 3.1 | 3.6 | 3.6 | 3.4 | 3.3 | 3.2 | 3.0 | 3.7 |
| 1100 | " | $H_2O$ | 3.4 | 3.7 | 4.2 | 3.9 | 3.7 | 4.2 | 3.9 | 4.2 | 3.3 | 3.0 |
| | " | 1N KOH | 3.2 | 3.4 | 3.3 | 3.4 | 3.6 | 3.5 | 3.8 | 3.9 | 4.3 | 3.9 |
| 600 | " | $H_2O$ | 3.6 | 3.9 | 4.2 | 4.3 | 4.0 | 4.6 | 4.3 | 4.2 | 3.7 | 4.0 |
| | " | 1N KOH | 3.2 | 3.4 | 3.6 | 3.9 | 3.7 | 3.8 | 3.2 | 3.1 | 4.6 | 4.8 |
| 1800 | $H_2SO_4$ | $H_2O$ | 2.6 | 2.7 | 2.3 | 2.4 | 2.5 | 2.9 | 2.9 | 2.8 | 2.8 | 2.4 |
| | " | 1N KOH | 2.1 | 2.2 | 2.4 | 2.3 | 2.2 | 2.4 | 2.5 | 2.4 | 2.3 | 2.1 |
| 1100 | " | $H_2O$ | 2.6 | 2.6 | 2.7 | 2.9 | 2.9 | 2.9 | 2.1 | 2.3 | 2.2 | 2.1 |
| | " | 1N KOH | 1.9 | 3.1 | 2.1 | 2.3 | 2.3 | 2.4 | 2.4 | 2.4 | 2.3 | 2.7 |
| 600 | " | $H_2O$ | 2.7 | 2.8 | 2.9 | 3.1 | 2.9 | 2.8 | 2.7 | 2.6 | 2.5 | 2.6 |
| | " | 1N KOH | 2.8 | 2.8 | 2.7 | 2.5 | 2.6 | 2.4 | 2.5 | 3.1 | 2.6 | 2.7 |

*Degree of polymerization

When a series of the cross-linking agents used in the Examples of U.S. Pat. No. 3,586,503 were used instead of the cross-linking agent used in this Example, the polyvinyl alcohol coatings obtained exhibited far higher degrees of swelling than in the present Example.

EXAMPLE 3

A color diffusion transfer process was conducted using a cellulose triacetate film coated with a mixture of polyvinyl alcohol and poly-4-vinyl pyridine as shown in Example 2 as an image-receiving layer, a dye developer, a negative emulsion layer, and an alkaline processing solution.

The negative emulsion layer was exposed and superimposed over the image-receiving layer, and the processing solution was spread between them in a thickness of 190 microns to develop the silver halide photographic emulsion and transfer the color developer. After transferring for 1 to 5 minutes, the image-receiving layer and the negative emulsion layer were stripped apart. No particular formation of creases or spots was seen on the surface of the image-receiving layer. No change occurred when the image-receiving layer was rinsed with water for 3 minutes after transferring.

The above procedures were repeated except that trimethylol melamine was not used in the image-receiving layer. When the transferring time exceeded 3 minutes, large creases were formed on the surface of the image-receiving layer. When the image-receiving layer was rinsed with water for 3 minutes, far larger creases were formed.

The alkaline processing solution and the negative emulsion layer used in the above experiments had the following compositions.

Alkaline Processing Solution

| | |
|---|---|
| Hydroxyethyl Cellulose (high viscosity) | 3.5 g |
| Potassium Hydroxide | 6.3 g |
| Benzotriazole | 2.0 g |
| 1-Benzyl-2-picolinium Bromide | 2.0 g |
| Sodium Thiosulfate | 1.0 g |
| Water to make | 100 g |

For each transfer, 5 ml per 100 $cm^2$ of the negative layer of the treating liquor was used.

Negative Emulsion Layer

A cellulose triacetate film support was coated with a gelatin sub-layer, and on the gelatin layer were coated the following layers in order.

1. Dye Developer Layer 10 g of 1-phenyl-3-N-n-hexylcarboxamide-4-[p-(2',5'-dihydroxyphenethyl)phenylazo]-5-pyrazolone was dissolved with heating in a mixture of 10 ml of N-n-butyl acetanilide and 25 ml of cyclohexanone. The resulting solution was emulsified and dispersed in 100 mg of a 10% aqueous solution of gelatin containing 8 ml of a 5% aqueous solution of sodium p-n-dodecylbenzene-sulfonate. To the resulting emulsion, 5 ml of a 2% aqueous solution of 1-hydroxy-4,6-dichloro-s-triazine was added. Water was further added to adjust the total amount to 300 ml. The resulting aqueous solution of the emulsion was coated in a dry thickness of 1.5 microns.

2. Silver Halide Emulsion Layer

A silver iodobromide emulsion containing $3.5 \times 10^{-2}$ mol of silver and 6.5 g of gelatin per 100 g thereof and 7 mol%, based on the total halogen ion, of iodine ion was coated in a dry thickness of 1.5 microns.

3. Protective Layer 5 g of 4'-methylphenylhydroquinone was dissolved in a mixture of 10 ml of tri-o-cresyl phosphate and 10 ml of ethyl acetate, and the solution was emulsified and dispersed in 10 ml of a 10% aqueous solution of gelatin containing 2 ml of a 5% aqueous solution of sodium n-dodecylbenzenesulfonate. 100 ml of an aqueous solution containing 10 g of the resulting emulsion and 5 ml of a 25% aqueous solution of mucochloric acid was coated in a thickness of 1 micron.

While the invention has been described in detail and with reference to specific embodiments thereof, it will be apparent to one skilled in the art that various changes and modifications can be made therein without departing from the spirit and scope thereof.

What is claimed is:

1. An image-receiving element for color diffusion transfer photography for use with a photographic element containing at least one silver halide emulsion layer having incorporated therein a dye image-forming material that is soluble in alkaline solution and becomes diffusible upon development of the silver halide emulsion layer with an alkaline processing solution, and to which the dye image-forming material is imagewise transferred when the alkaline processing solution is spread between the image-receiving element and the photographic element; in which the image-receiving element comprises a support having at least one layer thereon, at least one layer of the image-receiving element being a hydrophilic image-receiving layer consisting essentially of polyvinyl alcohol or a mixture of at least 50 weight percent polyvinyl alcohol and one or more natural or other synthetic polymers and a polymethylol compound selected from the group of polymethylol compounds represented by the general formula (III)

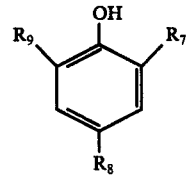

(III)

wherein $R_7$, $R_8$ and $R_9$ each represents a hydrogen atom, a methylol group or an alkyl group and at least two of $R_7$ to $R_9$ are methylol groups and wherein said layer containing said polymethylol compound also contains a non-volatile acid as a cross-linking promoter.

2. The image-receiving element of claim 1, wherein said polyvinyl alcohol has a degree of saponification of about 80 to 98 mol% and a degree of polymerization of about 600 to 2000.

3. The image-receiving element of claim 1, wherein said methylol compound-containing layer further contains poly-4-vinyl pyridine.

4. The image-receiving element of claim 1, wherein the amount of said polymethylol compound is about 0.1 to 10% by weight based on the weight of said polyvinyl alcohol.

5. The image-receiving element of claim 4, wherein the amount of said polymethylol compound is 0.5 to 5% by weight.

6. A color diffusion transfer photographic unit comprising 1. a silver halide photosensitive element comprising a support having thereon at least one silver halide emulsion layer having a dye developer associated therewith for forming a dye image upon development of the silver halide photosensitive element;
2. an image-receiving element for receiving the dye image of the photosensitive element upon development comprising a support having thereon at least one layer, at least one layer of the image-receiving element being an image-receiving layer consisting essentially of polyvinyl alcohol or a mixture of at least 50 weight percent polyvinyl alcohol and one or more other natural or synthetic polymers and a polymethylol compound selected from the compounds represented by the general formula (III),

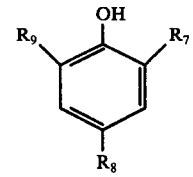

(III)

wherein $R_7$, $R_8$ and $R_9$ each represents a hydrogen atom, a methylol group or an alkyl group and at least two of $R_7$ to $R_8$ are methylol groups and wherein said layer containing said polymethylol compound also contains a non-volatile acid as a cross-linking promoter.

7. The image-receiving element of claim 1 wherein said non-volatile acid is phosphoric acid, sulfuric acid or benzenesulfonic acid.

8. The color diffusion transfer photographic unit of claim 6 wherein said non-volatile acid is phosphoric acid, sulfuric acid or benzenesulfonic acid.

* * * * *